US009201331B2

(12) United States Patent
Shinohara et al.

(10) Patent No.: US 9,201,331 B2
(45) Date of Patent: Dec. 1, 2015

(54) IMAGE FORMING APPARATUS, IMAGE CORRECTING METHOD, COMPUTER READABLE STORAGE MEDIUM, IMAGE CORRECTION UNIT AND IMAGE FORMING SYSTEM

(71) Applicants: Tadashi Shinohara, Kanagawa (JP); Yasuhiro Abe, Kanagawa (JP); Hiroaki Nishina, Kanagawa (JP); Yutaka Ohmiya, Tokyo (JP)

(72) Inventors: Tadashi Shinohara, Kanagawa (JP); Yasuhiro Abe, Kanagawa (JP); Hiroaki Nishina, Kanagawa (JP); Yutaka Ohmiya, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 10 days.

(21) Appl. No.: 14/020,028

(22) Filed: Sep. 6, 2013

(65) Prior Publication Data

US 2014/0072316 A1 Mar. 13, 2014

(30) Foreign Application Priority Data

Sep. 13, 2012 (JP) ..... 2012-202069

(51) Int. Cl.

| | |
|---|---|
| ***G03G 15/00*** | (2006.01) |
| ***G03G 15/01*** | (2006.01) |
| ***G03G 13/01*** | (2006.01) |

(52) U.S. Cl.

CPC ..... *G03G 15/0105* (2013.01); *G03G 13/01* (2013.01); *G03G 15/0131* (2013.01); *G03G 15/5058* (2013.01); *G03G 2215/0161* (2013.01)

(58) Field of Classification Search

CPC ..... G03G 15/5058; G03G 2215/0161

USPC ..... 399/49, 301

See application file for complete search history.

(56) References Cited

U.S. PATENT DOCUMENTS

| | | | |
|---|---|---|---|
| 5,621,221 | A | 4/1997 | Shinohara et al. |
| 5,737,665 | A | 4/1998 | Sugiyama et al. |
| 5,765,083 | A | 6/1998 | Shinohara |
| 5,875,380 | A | 2/1999 | Iwata et al. |
| 5,899,597 | A | 5/1999 | Shinohara et al. |
| 5,962,783 | A | 10/1999 | Iwata et al. |
| 6,118,557 | A | 9/2000 | Sugiyama et al. |
| 6,128,459 | A | 10/2000 | Iwata et al. |
| 6,282,396 | B1 | 8/2001 | Iwata et al. |
| 6,295,435 | B1 | 9/2001 | Shinohara et al. |
| 6,380,960 | B1 | 4/2002 | Shinohara |

(Continued)

FOREIGN PATENT DOCUMENTS

| | | |
|---|---|---|
| JP | 2005-289035 | 10/2005 |
| JP | 2006-293240 | 10/2006 |

*Primary Examiner* — David Bolduc

(74) *Attorney, Agent, or Firm* — Oblon, McClelland, Maier & Neustadt, L.L.P.

(57) ABSTRACT

An image forming apparatus includes: at least one first image carrier configured to carry an electrostatic latent image thereon; an image writing unit; a second image carrier configured to move along a transfer position facing to the at least one first image carrier; a first transfer unit provided opposite to the at least one first image carrier; a second transfer unit configured to transfer the subject image to a transfer material; a test pattern detection unit configured to detect the test pattern image; a control unit configured to correct an image forming condition of the subject image based on a result from the detection of the test pattern image, wherein the test pattern image is provided on the second image carrier at an area being out of the image forming area and being at the same range as the subject image in a scanning direction.

12 Claims, 11 Drawing Sheets

(56) References Cited

U.S. PATENT DOCUMENTS

| | | | | |
|---|---|---|---|---|
| 7,616,909 | B2 * | 11/2009 | Kato et al. | 399/49 |
| 8,064,811 | B2 * | 11/2011 | Sato et al. | 399/301 |
| 8,238,772 | B2 * | 8/2012 | Higuchi et al. | 399/59 |
| 8,355,645 | B2 * | 1/2013 | Mizumukai | 399/72 |
| 8,457,516 | B2 * | 6/2013 | Fujiwara | 399/72 |
| 8,467,693 | B2 * | 6/2013 | Higuchi et al. | 399/59 |
| 2001/0004425 | A1 | 6/2001 | Shinohara et al. | |
| 2002/0024580 | A1 | 2/2002 | Kobayashi et al. | |
| 2003/0052958 | A1 | 3/2003 | Shinohara | |
| 2003/0063917 | A1 | 4/2003 | Shinohara | |
| 2003/0137577 | A1 | 7/2003 | Shinohara | |
| 2003/0156179 | A1 | 8/2003 | Kobayashi et al. | |
| 2004/0041896 | A1 | 3/2004 | Shinohara | |
| 2004/0164691 | A1 | 8/2004 | Andoh et al. | |
| 2005/0009351 | A1 | 1/2005 | Takahashi et al. | |
| 2005/0042001 | A1 | 2/2005 | Shinohara et al. | |
| 2005/0053388 | A1 | 3/2005 | Yokoyama et al. | |
| 2005/0057209 | A1 | 3/2005 | Andoh et al. | |
| 2005/0085945 | A1 | 4/2005 | Andoh et al. | |
| 2005/0088505 | A1 | 4/2005 | Shinohara | |
| 2005/0200689 | A1 | 9/2005 | Shinohara et al. | |
| 2005/0238372 | A1 | 10/2005 | Shinohara et al. | |
| 2006/0001891 | A1 | 1/2006 | Yoshida | |
| 2006/0164497 | A1 | 7/2006 | Shinohara | |
| 2006/0233561 | A1 | 10/2006 | Yamaoka | |
| 2006/0275057 | A1 * | 12/2006 | Suzuki | 399/301 |
| 2006/0285863 | A1 * | 12/2006 | Noguchi et al. | 399/49 |
| 2007/0025779 | A1 | 2/2007 | Shinohara | |
| 2007/0115509 | A1 | 5/2007 | Shinohara | |
| 2007/0122210 | A1 | 5/2007 | Sato et al. | |
| 2007/0140721 | A1 | 6/2007 | Shinohara et al. | |
| 2007/0189815 | A1 | 8/2007 | Andoh et al. | |
| 2007/0231002 | A1 | 10/2007 | Kouzu | |
| 2008/0123139 | A1 * | 5/2008 | Harada et al. | 358/1.18 |
| 2008/0279570 | A1 | 11/2008 | Shinohara | |
| 2010/0158554 | A1 * | 6/2010 | Suzuki | 399/67 |
| 2012/0008154 | A1 | 1/2012 | Abe | |
| 2012/0224191 | A1 | 9/2012 | Abe | |
| 2013/0022364 | A1 | 1/2013 | Abe | |
| 2013/0236200 | A1 * | 9/2013 | Tanaka et al. | 399/49 |

* cited by examiner

IMAGE FORMING APPARATUS, IMAGE CORRECTING METHOD, COMPUTER READABLE STORAGE MEDIUM, IMAGE CORRECTION UNIT AND IMAGE FORMING SYSTEM

CROSS-REFERENCE TO RELATED APPLICATIONS

The present application claims priority to and incorporates by reference the entire contents of Japanese Patent Application No. 2012-202069 filed in Japan on Sep. 13, 2012.

BACKGROUND OF THE INVENTION

1. Field of the Invention

The present invention relates to an image forming apparatus, an image adjusting method, and a program product.

2. Description of the Related Art

Image adjustment including positional deviation correction and density correction is performed by forming a test pattern image with a toner on an intermediate transfer belt and then detecting the image with a sensor in a copying machine or a multi function peripherals (MFP) that is equipped with a plurality of functions such as a copying machine, a facsimile, and a printer in a housing (for example, Japanese Patent No. 4359199).

A normal image print cannot be performed during such image adjustment. Thus, frequent image adjustment causes a problem in that the number of times that a print operation cannot be performed due to image adjustment or, namely, downtimes increases and this decreases the productivity of the apparatus. A method in which a test pattern image is formed at a main-scanning direction edge outside the print region and the test pattern image is detected in parallel with the image print is known as a method for reducing the number of downtimes. This can perform image adjustment while printing an image in real time.

Japanese Laid-open Patent Publication No. 2006-293240 discloses that a configuration configured to switch a mode in which a test pattern image is formed at a main-scanning direction edge at the outer side of a transfer sheet depending on the width of the transfer sheet and a mode in which the interval between the sheets is extended in order to form a test pattern image at the main-scanning direction edge between the sheets, for example, when the test pattern image cannot be formed at the main-scanning direction edge at the outer side of the transfer sheet.

However, there is a problem, even in the configuration described in Japanese Laid-open Patent Publication No. 2006-293240, in that forming a test pattern image with extending the interval between the sheets reduces the throughput. As described above, the apparatuses in the past have a problem in that the throughput is reduced when the transfer sheets have different sizes, for example, because of print jobs for transfer sheets having different sizes while test pattern images are formed at the main-scanning direction edges outside the print regions over a plurality of pages in parallel with the image print.

In light of the foregoing, an objective of the present invention is to provide an image forming apparatus, an image adjusting method, a program and a computer-readable storage medium that are capable of adjusting an image without reducing the throughput.

SUMMARY OF THE INVENTION

It is an object of the present invention to at least partially solve the problems in the conventional technology.

According to an aspect of the invention, an image forming apparatus is provided. An image forming apparatus includes: at least one first image carrier configured to carry an electrostatic latent image thereon; an image writing unit configured to write the electrostatic latent image onto the at least one first image carrier, the electrostatic latent image including a test pattern image; a second image carrier configured to move along a transfer position facing to the at least one first image carrier; a first transfer unit provided opposite to the at least one first image carrier across the second image carrier and configured to obtain a subject image by transferring the electrostatic latent image carried on the at least one first carrier onto the second image carrier in a superimposing manner; a second transfer unit provided in contact with the second image carrier and configured to transfer the subject image transferred on the second image carrier to a transfer material and convey the transfer material; a test pattern detection unit configured to detect the test pattern image; a control unit configured to correct an image forming condition of the subject image based on a result from the detection of the test pattern image, wherein the test pattern image is provided on the second second image carrier at an area being out of the image forming area and being at the same range as the subject image in a scanning direction.

According to another aspect of the invention, an image adjusting method performed in an image forming apparatus is provided. The image adjusting method includes: by the control unit, determining whether or not difference between the length of the transfer material in a direction perpendicular to the conveying way and the width of the second image carrier is sufficient to form the test pattern image; instructing the writing unit to write the electrostatic latent images of the subject image and the test pattern image when a decision that the difference is sufficient to form the test pattern image is made by the control unit; by the test pattern detecting unit, detecting the test pattern image; and correcting image forming condition by averaging the result from the detection of the test pattern image to specify the misalignment of the subject image.

According to further aspect of the invention, a computer readable storage medium storing a program causing a computer to perform the method mentioned above is provided.

According to further aspect of the invention, an image correction unit for correcting an image formed by an image forming apparatus is provided. The image forming apparatus includes: at least one first image carrier configured to carry an electrostatic latent image thereon; an image writing unit configured to write the electrostatic latent image onto the at least one first image carrier, the electrostatic latent image including a test patter image; a second image carrier configured to move along a transfer position facing to the at least one first image carrier; a first transfer unit provided opposite to the at least one first image carrier across the second image carrier and configured to obtain a subject image by transferring the electrostatic latent image carried on the at least one first carrier onto the second image carrier in a superimposing manner; and a second transfer unit provided in contact with the second image carrier and configured to transfer the subject image transferred on the second image carrier to a transfer material and convey the transfer material, wherein the test pattern image is provided on the second image carrier at an area being out of the image forming area and being at the same range as the subject image in a scanning direction. The image correcting unit includes: a test pattern detection unit configured to detect the test pattern image; a memory connected to the test pattern detection unit; a control unit connected to the test pattern detection unit and the memory and configured to perform a correction procedure stored in the memory based on a result from the detection of the test pattern detection unit; and an image writing control unit connected to the control unit and configured to control the image writing unit based on the setting value corrected by the control unit, wherein the control unit instructs the image writing unit to write the image pattern when the control unit determines that difference between the length of the transfer material in a direction perpendicular to the conveying way and the width of the second image carrier is sufficient to form the test pattern image.

According to further aspect of the invention, an image forming system is provided. The image forming system includes an image forming apparatus and image data producing unit for transmitting the image data to be formed to the image forming apparatus. The image forming apparatus includes: at least one first image carrier configured to carry an electrostatic latent image thereon; an image writing unit configured to write the electrostatic latent image onto the at least one first image carrier, the electrostatic latent image including a test patter image; a second image carrier configured to move along a transfer position facing to the at least one first image carrier; a first transfer unit provided opposite to the at least one first image carrier across the second image carrier and configured to obtain a subject image by transferring the electrostatic latent image carried on the at least one first carrier onto the second image carrier in a superimposing manner; a second transfer unit provided in contact with the second image carrier and configured to transfer the subject image transferred on the second image carrier to a transfer material and convey the transfer material; a test pattern detection unit configured to detect the test pattern image; a control unit configured to correct an image forming condition of the subject image based on a result from the detection of the test pattern image, wherein the test pattern image is provided on the second image carrier at an area being out of the image forming area and being at the same range as the subject image in a scanning direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, the preferred embodiments of the image processing apparatus according to the present invention will be described in detail with reference to the accompanying drawings.

Figure 1:
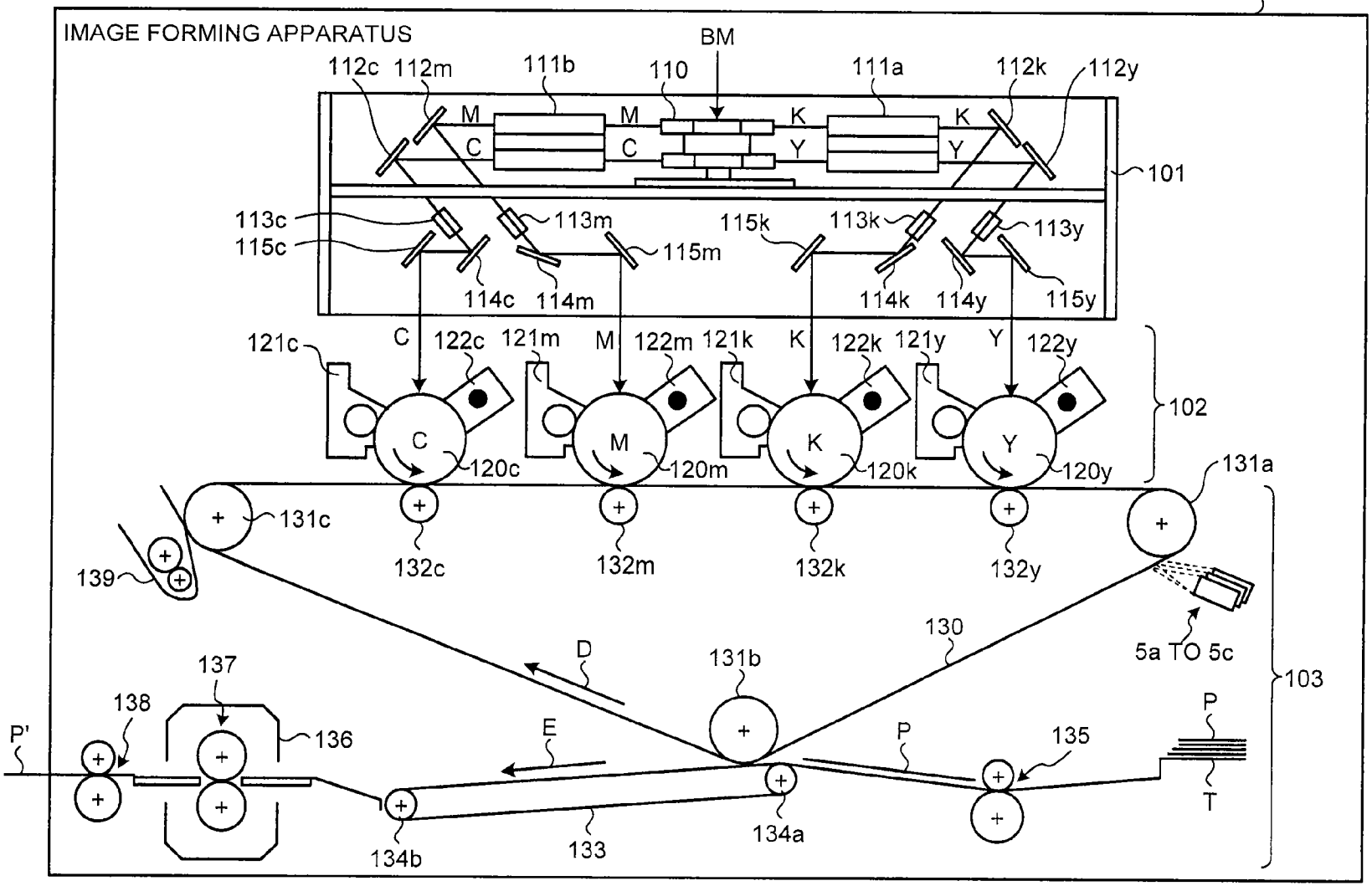
FIG. 1 is a block diagram of the structure of an image forming apparatus according to an embodiment of the present invention.

FIG. 1 is a block diagram of the structure of an image forming apparatus according to an embodiment of the present invention. An image forming apparatus 100 is an image forming apparatus including, for example, a facsimile apparatus, a printing apparatus (printer), a copying machine, and an MFP. The image forming apparatus 100 includes an optical apparatus 101 including optical components such as a semiconductor laser light source, and a polygon mirror; a image forming unit 102, for example, including a drum-shaped photosensitive element (also referred to as a "photosensitive drum"), a charger, a developing unit, and the like; and a transferring unit 103 including an intermediate transfer belt and the like.

The optical apparatus 101 polarizes light beams BM emitted from a plurality of light sources (not illustrated in the drawings) that are the semiconductor light sources including a laser diode (LD) using a polygon mirror 110 in order to cause the light beams BM to enter scanning lenses 111*a* and 111*b* including an fθ lens. The number of light beams BM corresponding to the images of the colors, yellow (Y), cyan (C), magenta (M) and black (K) is generated. The light beams are reflected by reflecting mirrors 112*y*, 112*k*, 112*m*, and 112*c* after passing through the scanning lenses 111*a* and 111*b*, respectively. For example, a yellow light beam Y passes through the scanning lens 111*a* and is reflected by the reflecting mirror 112*y* in order to enter a WTL lens 113*y*. Each of the descriptions of black, magenta, cyan light beams K, M, and C is omitted because the light beams do the same as the light Y does.

WTL lenses 113*y*, 113*k*, 113*m*, and 113*c* polarize the light beams Y, K, M, and C toward reflecting mirrors 114*y*, 114*k*, 114*m*, and 114*c*, respectively, after shaping the light beams Y, K, M, and C. The light beams Y, K, M, and C are further reflected by reflecting mirrors 115*y*, 115*k*, 115*m*, and 115*c* and fall onto photosensitive drums (hereinafter, abbreviated to "photosensitive elements") 120*y*, 120*k*, 120*m*, and 120*c* as the light beams Y, K, M, and C used for the exposures while having the shapes of the image.

The photosensitive elements 120*y*, 120*k*, 120*m*, and 120*c* are irradiated with the light beams Y, K, M, and C using a plurality of optical components as described above. The timings in the main-scanning directions and the sub-scanning directions of the photosensitive elements 120*y*, 120*k*, 120*m*, and 120*c* are synchronized. Hereinafter, the main-scanning directions for the photosensitive elements 120*y*, 120*k*, 120*m*, and 120*c* will be defined as the scanning direction of the light beams. The sub-scanning directions will be defined as a direction orthogonal to the main-scanning direction or, namely, a direction in which the photosensitive elements 120*y*, 120*k*, 120*m*, and 120*c* rotate.

Each of the photosensitive elements 120*y*, 120*k*, 120*m*, and 120*c* includes a photoconductive layer including at least a charge generating layer and a charge transporting layer on a conductive drum, for example, made of aluminum. The photoconductive layer is arranged at each of the photosensitive elements 120*y*, 120*k*, 120*m*, and 120*c*. Each of chargers 122*y*, 122*k*, 122*m*, and 122*c* including a corotron, a scorotron, a roller charging device, or the like puts surface charges on the photoconductive layer.

The static charges put on each of the photosensitive elements 120*y*, 120*k*, 120*m*, and 120*c* by the chargers 122*y*, 122*k*, 122*m*, and 122*c* are exposed with the light beams Y, K, M, and C while forming the shapes of the images. This forms electrostatic latent images on the scanned surfaces of the photosensitive elements 120*y*, 120*k*, 120*m*, and 120*c*.

Each of the electrostatic latent images formed on the scanned surfaces of the photosensitive elements 120*y*, 120*k*, 120*m*, and 120*c* is developed using developing units 121*y*, 121*k*, 121*m*, and 121*c* including a developing sleeve, a developer supplying roller, a regulating blade, and the like. This forms developer images on the scanned surfaces of the photosensitive elements 120*y*, 120*k*, 120*m*, and 120*c*.

The developer carried on each of the scanned surfaces of the photosensitive elements 120*y*, 120*k*, 120*m*, and 120*c* is transferred, using primary transfer rollers 132*y*, 132*k*, 132*m*, and 132*c* for the photosensitive elements 120*y*, 120*k*, 120*m*, and 120*c*, on an intermediate transfer belt 130 that runs in a direction of an arrow D with carriage rollers 131*a*, 131*b*, and 131*c*.

The intermediate transfer belt 130 is conveyed to a secondary transfer unit while carrying the Y, K, M, and C developer transferred from the scanned surfaces of the photosensitive elements 120*y*, 120*k*, 120*m*, and 120*c*.

The secondary transfer unit includes a secondary transfer belt 133, and carriage rollers 134*a* and 134*b*. The secondary transfer belt 133 is conveyed in a direction of an arrow E with the carriage rollers 134*a* and 134*b*. A sheet P that is a transfer material such as high-quality paper or a plastic sheet is fed from a sheet housing unit T such as a paper cassette to the secondary transfer unit with a carriage roller 135. The secondary transfer unit applies secondary transfer bias in order to transfer the multicolor developer images carried on the intermediate transfer belt 130 to the sheet P adsorbed and held on the secondary transfer belt 133. The sheet P is fed to a fixing apparatus 136 while the secondary transfer belt 133 is conveyed. The fixing apparatus 136 includes a fixing member 137 that is, for example, a fixing roller including silicone rubber, fluorine-contained rubber or the like in order to press and heat the sheet P and the multicolor developer images so that a discharging roller 138 discharges the sheet P to the outside of the image forming apparatus 100 as a printed material P'.

The intermediate transfer belt 130 after transferring the multicolor developer images is supplied for the next image forming process after a cleaning unit 139 including a cleaning blade removes the developer left from the transfer.

Three detecting sensors (also referred to as "detection sensor") 5*a*, 5*b*, and 5*c* for detecting a test pattern image (including a "positional deviation correcting test pattern image" and a "density correcting test pattern image") for correcting an image forming condition under which a color image is formed on the intermediate transfer belt 130 are provided near the carriage rollers 131*a*. The test pattern images are formed together with a color image on the intermediate transfer belt 130. Reflective detecting sensors each including a known reflective photo sensor can be used as the detecting sensors 5*a*, 5*b*, and 5*c*. The various deviation amounts including the skew of each color from the standard color, the deviation amount of the main-scanning registration, the deviation amount of the sub-scanning registration, and the errors of the main-scanning magnifications are calculated based on the result from the detection with each of the detecting sensors 5*a*, 5*b*, and 5*c*. The various deviation amounts with relation to image quality adjustment are corrected based on the calculated results in order to correct the image forming conditions under which a color image is formed on the intermediate transfer belt 130 (positional deviation correction and density correction), such that the various processes for generating a test pattern image in the image adjustment are performed.

Figure 2:
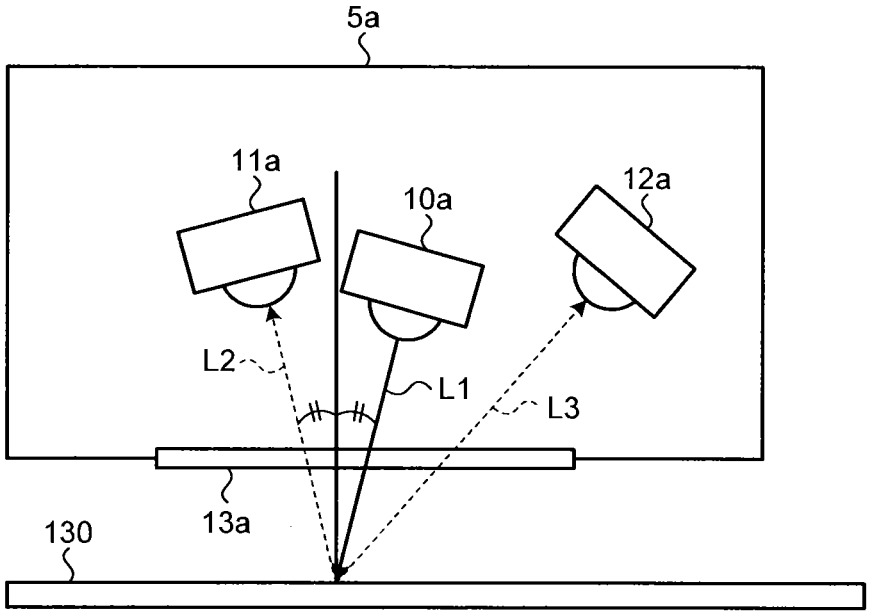
FIG. 2 is a schematic view of the internal structure of one of the detecting sensors illustrated in FIG. 1.

FIG. 2 is a schematic view of the internal structure of the detecting sensor 5*a* illustrated in FIG. 1. While FIG. 2 illustrates the detecting sensor 5*a*, the descriptions for the detecting sensors 5*b* and 5*c* are omitted because the detecting sensors 5*a*, 5*b*, and 5*c* have the same internal structure.

The detecting sensor 5*a* includes a light-emitting element 10*a*, two light-receiving elements 11*a* and 12*a*, and a condenser lens 13*a*. The light-emitting element 10*a* is a light-emitting device configured to generate a light, for example, an infrared light LED configured to generate an infrared light. The light-receiving element 11*a* is, for example, a specular reflective light-receiving device. The light-receiving element 12*a* is, for example, a diffuse reflective light-receiving device.

At the detecting sensor 5*a*, a light L1 emitted from the light-emitting element 10*a* reaches a test pattern image (not illustrated in the drawings) on the intermediate transfer belt 130 after penetrating the condenser lens 13*a*. Then, a part of the light is specularly reflected at a test pattern forming region or at the toner layer of the test pattern forming region and becomes a specular reflective light L2. After that, the part of the light penetrates the condenser lens 13*a* again and is received at the light-receiving element 11*a*. Another part of the light is diffusively reflected at the test pattern forming region or at the toner layer of the test pattern forming region and becomes a diffuse reflective light L3. After that, the part of the light penetrates the condenser lens 13*a* again and is received at the light-receiving element 12*a*.

Note that a laser element or the like can be used as the light-emitting element instead of the infrared light LED. Although phototransistors are used as both of the light-receiving elements 11*a* and 12*a* (the specular reflective light-receiving device and the diffuse reflective light-receiving device), elements including a photodiode, an amplifier circuit, or the like can be used as the light-receiving elements 11*a* and 12*a*.

Figure 3:
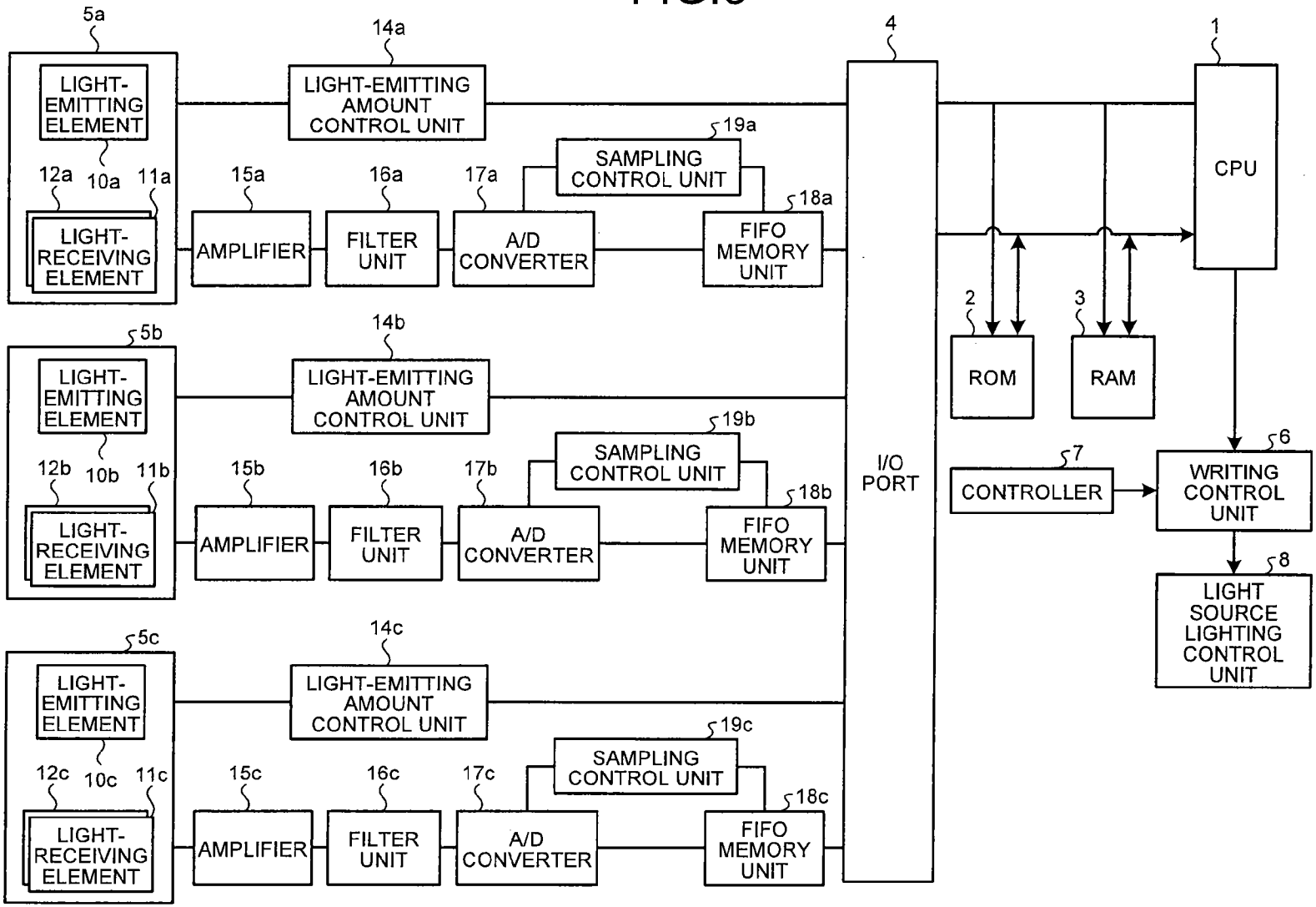
FIG. 3 is a block diagram for illustrating, together with the internal structures of the detecting sensors in the image forming apparatus, the functional configuration that controls the processing of the data detected with the detecting sensors of the control unit in the image forming apparatus and the writing of the image after the processing.

FIG. 3 is a block diagram for illustrating, together with the internal structures of the detecting sensors 5*a*, 5*b*, and 5*c* in the image forming apparatus 100, the functional configuration that controls the processing of the data detected with the detecting sensors 5*a*, 5*b*, and 5*c* of the control unit in the image forming apparatus 100 and the writing of the image after the processing. The detecting sensors 5*a*, 5*b*, and 5*c* in the image forming apparatus 100 include the light-emitting elements 10*a*, 10*b*, and 10*c*, and the light-receiving elements 11*a*, 11*b*, 11*c*, and 12*a*, 12*b*, 12*c*, respectively. Note that the condenser lens 13*a* illustrated in FIG. 2 and the condenser lenses of the detecting sensors 5*b* and 5*c* are omitted in FIG. 3.

The control unit of the image forming apparatus 100 includes a CPU 1, a ROM 2, a RAM 3, and an input/output (I/O) port 4, and further includes light-emitting amount control units 14*a*, 14*b*, and 14*c*, amplifiers (AMP) 15*a*, 15*b*, and 15*c*, filter units 16*a*, 16*b*, and 16*c*, analog/digital (A/D) converters 17*a*, 17*b*, and 17*c*, First-In First-Out (FIFO) memory units 18*a*, 18*b*, and 18*c*, and sampling control units 19*a*, 19*b*, and 19*c*, as a functional unit for the processing of the data detected at the detecting sensors 5*a*, 5*b* and 5*c*. The control unit of the image forming apparatus 100 further includes a writing control unit 6, a controller 7, and a light source lighting control unit 8 as a functional unit for the writing of the image after the process.

The ROM 2 stores various programs for controlling the image forming apparatus 100 such as a program including the procedures executed by the CPU 1 in order to perform various processes including the correction process for correcting an image forming condition under which a color image is formed on the intermediate transfer belt 130, the positional deviation amount calculating process for calculating the amount of the positional deviation in the main-scanning direction when a pattern image is formed on the intermediate transfer belt 130, and the pattern image correcting process.

The CPU 1 monitors detection signals from the light-receiving elements 11*a*, 11*b*, and 11*c* at appropriate times, and control the amount of emitted lights with the light-emitting amount control units 14*a*, 14*b*, and 14*c* in such a way as to surely detect the signals, for example, even when the carriage belt and the light-emitting elements 10*a*, 10*b*, and 10*c* are deteriorated. This keeps the light-receiving signals from the light-receiving elements 11*a*, 11*b*, and 11*c* at a constant level. The RAM 3 is, for example, an NVRAM and also stores various parameters.

Next, the processing of the data detected at the detecting sensors 5*a*, 5*b*, and 5*c* will be described with reference to FIG. 3. The CPU 1 executes the program stored in the ROM 2 using the RAM 3 as a working area in order to control the light-emitting amount control units 14*a*, 14*b*, and 14*c* through the I/O port 4 in order to emit a predetermined amount of light beams from the light-emitting elements 10*a*, 10*b*, and 10*c* of the detecting sensors 5*a*, 5*b*, and 5*c* in the detection of the test pattern image to be described below.

First, the light beam emitted from the light-emitting element 10*a* of the detecting sensor 5*a* will be described. The light beam falls onto a test pattern image. The light reflected therefrom is received at each of the light-receiving elements 11*a* and 12*a* of the detecting sensor 5. The light-receiving elements 11*a* and 12*a* transmit the data signals corresponding to the amounts of lights of the received light beams to the amplifier 15*a*. The amplifier 15*a* amplifies the data signals and transmits the data signals to the filter unit 16*a*. The filter unit 16*a* passes only the signal component detecting the lines in the signals output from the amplifier 15*a* and transmits the signal to the A/D converter 17*a*. The A/D converter 17*a* converts the analog data of the signal output from the filter unit 16*a* into digital data. Then, the sampling control unit 19*a* samples the digital data converted at the A/D converter 17*a* and stores the digital data in the FIFO memory unit 18*a*.

Similarly to the above, the data signal obtained from the light-receiving elements 11*b* and 12*b* of the detecting sensor 5*b* is stored in the FIFO memory unit 18*b* after being digitalized and sampled, and the data signal obtained from the light-receiving elements 11*c* and 12*c* of the detecting sensor 5*c* is stored in the FIFO memory unit 18*c* after being digitalized and sampled.

After the detections of the test pattern images have been completed as described above, the digital data stored in each of the FIFO memory units 18*a*, 18*b*, and 18*c* is loaded to the CPU 1 and the RAM 3 through the I/O port 4 and the data bus. The CPU 1 performs a predetermined calculating process for the data by executing the program stored in the ROM 2. Thus, the various processes including the correction process for correcting an image forming conditions under which a color image is formed on the intermediate transfer belt 130, the positional deviation amount calculating process for calculating the amount of the positional deviation in the main-scanning direction when a pattern image is formed on the intermediate transfer belt 130, and the pattern image correcting process are performed.

With controlling all the operations in the image forming apparatus 100, the CPU 1 and the ROM 2 function as control units that control the processing of the data detected at the detecting sensors 5*a*, 5*b*, and 5*c* in order to function as the correction unit, the positional deviation amount calculation unit, and the pattern image correction unit. The CPU 1 and the ROM 2 also function as a unit for disabling the pattern image correction unit.

After that, the CPU 1 sets the timing of the start of writing and the change of the pixel clock frequency in the writing control unit 6 based on the calculated amounts for the corrections.

The writing control unit 6 includes a device capable of very finely setting the output frequency, for example, a clock generator using a voltage controlled oscillator (VCO) so that the output can be used as the pixel clock. To write an image, the writing control unit 6 causes the light source to output the light beams BM (see FIG. 1) by driving the light source lighting control unit 8 according to the image data transmitted from the controller 7 based on the pixel clock.

Figure 4:
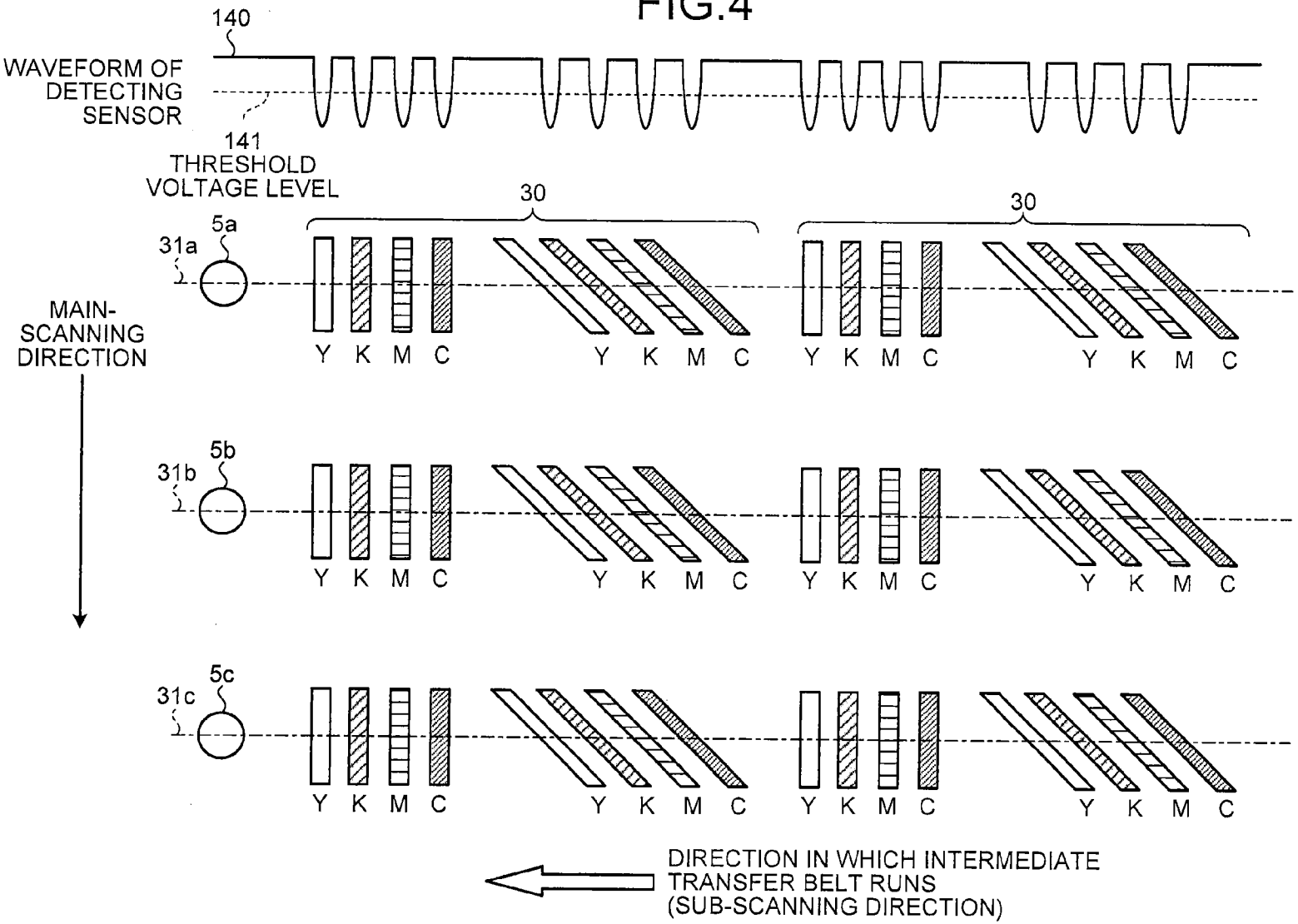
FIG. 4 is a view for illustrating marks in positional deviation correcting pattern images and an exemplary waveform of the signals of the marks detected by one of the detecting sensors.

Next, a case in which the positional deviation correcting pattern image is used as the test pattern image will be described. FIG. 4 is a view for illustrating marks in positional deviation correcting pattern images and an exemplary waveform of signals of the marks detected by one of the detecting sensors.

The positional deviation correcting pattern image is a set of predetermined patterns for the alignment for specular reflective lights. A set of marks 30 includes transverse patterns (also referred to as "horizontal patterns") and diagonal line patterns (also referred to as "diagonal patterns") formed in order of Y, K, M, and C as illustrated in FIG. 4. Eight sets of the marks 30 arranged in the sub-scanning direction are arranged in three rows in the main-scanning direction as corresponding to the detecting sensor 5*a*, 5*b*, and 5*c*, respectively. This forms a positional deviation correcting pattern image. Note that, as described below, the eight sets of the marks 30 arranged in the sub-scanning direction are sometimes arranged in two rows in the main-scanning direction as corresponding to the detecting sensor 5*a*, and 5*c*, respectively.

The transverse patterns are four patterns horizontal to the main-scanning direction for the photosensitive elements 120*y*, 120*k*, 120*m*, and 120*c* and having predetermined width and length. The diagonal line patterns are four patterns having a predetermined inclination to the main-scanning direction for the photosensitive elements 120*y*, 120*k*, 120*m*, and 120*c* (for example, 45°) and having predetermined width and length. Eight sets and three rows of transverse patterns and diagonal line patterns corresponding to each of the colors Y, K, M, and C are formed at each of the photosensitive elements 120*y*, 120*k*, 120*m*, and 120*c* and are transferred on the intermediate transfer belt 130. This forms the positional deviation correcting pattern image on the intermediate transfer belt 130 in the arrangement illustrated in FIG. 4.

The alternate long and short dash lines 31*a*, 31*b*, and 31*c* illustrated in FIG. 4 show the trails showing that the centers of the detecting sensor 5*a*, 5*b*, and 5*c* scan the patterns on the intermediate transfer belt 130 in the sub-scanning direction by, respectively. FIG. 4 illustrates an example of ideal trails showing that the centers of the detecting sensor 5*a*, 5*b*, and 5*c* pass through the centers of the patterns of the positional deviation correcting pattern image.

Note that the colors of each of the transverse patterns and the diagonal line patterns can be arranged in another order although FIG. 4 illustrates an example in which the transverse patterns and the diagonal line patterns are formed on the intermediate transfer belt 130 in such a way as to be arranged in order of Y, K, M, and C from the start in the direction in which the intermediate transfer belt 130 runs.

Then, the three rows of the marks of the positional deviation correcting pattern image formed on the intermediate transfer belt 130 are detected with the detecting sensors 5*a*, 5*b*, and 5*c* arranged in the main-scanning direction.

A waveform 140 illustrated in FIG. 4 is an example of the variation of the detection levels (detection signals) when the detecting sensor 5*a* detects the marks 30 of the positional deviation correcting pattern image illustrated in FIG. 4. Note that the waveforms of other detecting sensors 5*b* and 5*c* are omitted because the same waveform is obtained from the detecting sensors 5*b* and 5*c*.

For example, when the intermediate transfer belt 130 is white and the detection level is set as the standard level, the detection levels of the colored transverse patterns and diagonal line patterns decrease because the detecting sensors 5*a*, 5*b*, and 5*c* detect the intermediate transfer belt 130 at the parts except the colored transverse patterns and diagonal line patterns.

A threshold voltage level (voltage value) denoted with a dashed line 141 in FIG. 4 is a threshold set for detecting the part in which the level decreases to a level below the threshold voltage level as the transverse pattern or the diagonal line pattern even when the detection level decreases due to the stain on the intermediate transfer belt 130.

The detecting sensors 5*a*, 5*b*, and 5*c* detect each position of the eight sets of the transverse patterns and diagonal line patterns of the positional deviation correcting pattern image. The skews of the other colors (for example, yellow: Y, cyan: C, and magenta: M) from the standard color (black: K), the deviation amount of the main-scanning registration, the deviation amount of the sub-scanning registration, and the errors of the main-scanning magnifications are measured based on the detected result. The deviation amount between the positions of the centers of detecting sensors 5*a*, 5*b*, and 5*c* and the positions of the centers of the patterns of the positional deviation correcting pattern image are found based on the measured values. The found deviation amount can be stored as the positional deviation to be referenced when the next positional deviation correcting pattern image is formed. Further, the correction values of the skews, the deviation amount of the main-scanning registration, the deviation amount of the sub-scanning registration, and the errors of the main-scanning magnifications can be found.

Further, the detecting sensors 5*a*, 5*b*, and 5*c* detect the three rows of the marks, respectively. The average value is calculated from the detected results. The amounts of the skews, the deviation amount of the main-scanning registration, the deviation amount of the sub-scanning registration, and the errors of the main-scanning magnifications are found from the calculated result. This can accurately find each of the deviation amounts of the colors. Correcting the deviation amounts can form a high-quality image with extremely small deviations among the colors. Note that, when the detecting sensor 5*a* and 5*c* detect the two rows of the marks, the average value can also be calculated from the detected results.

A known correction amount calculating unit (not illustrated in the drawings) gives the executive instructions for the calculations of the amounts of the positional deviations and the amounts of the corrections, and for the corrections. Then, the detected positional deviation correcting pattern image is deleted with the cleaning unit 139 illustrated in FIG. 1.

Figure 5:
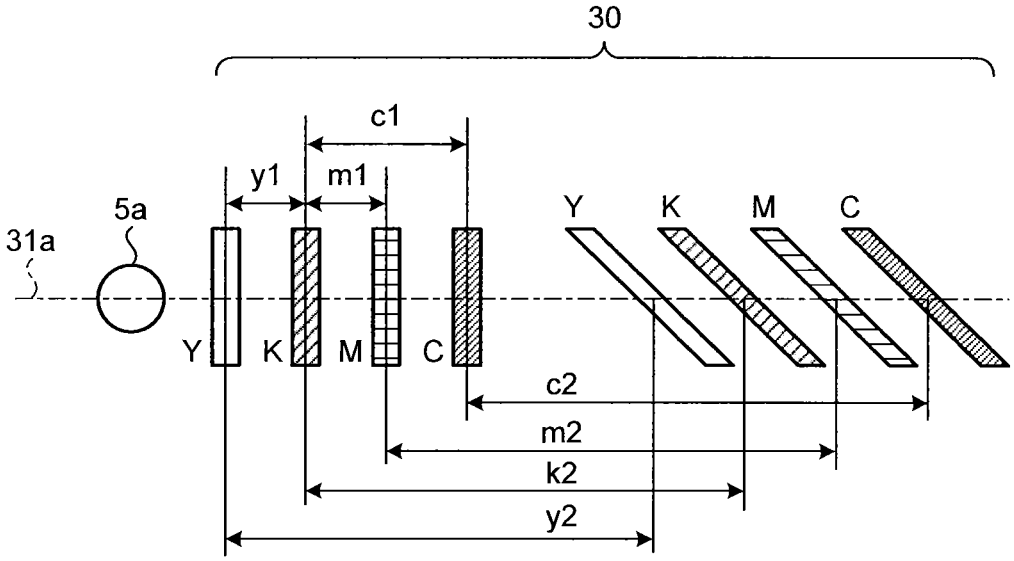
FIG. 5 is a view of the detecting sensor and a set of marks to be detected by the detecting sensor.

The method for calculating the amounts of the positional deviations when the positional deviation correcting pattern image in FIG. 4 is detected will be described in detail with reference to FIG. 5. FIG. 5 is a view of the detecting sensor 5*a* and a set of marks 30 to be detected by the detecting sensor 5*a*. Herein, the detection of the marks 30 of the positional deviation correcting pattern image by the detecting sensor 5*a* will be described. However, the same holds for the other detecting sensors 5*b* and 5*c*.

The detecting sensor 5*a* detects the transverse patterns and diagonal line patterns of the positional deviation correcting pattern image at predetermined sampling intervals, and the detecting sensor 5*a* notifies the detections to the CPU 1 illustrated in FIG. 3. While sequentially receiving the detections of the transverse patterns and diagonal line patterns from the detecting sensor 5*a*, the CPU 1 calculates each of the distances between the transverse patterns and the corresponding diagonal line patterns based on the intervals between the notifications of the detections and the time intervals of the samplings. This finds each of the lengths between the transverse patterns and the corresponding diagonal line patterns that have the same colors in a set of marks 30. Comparing the found lengths can find each of the positional deviations.

For example, in the calculation of the deviation amount of the sub-scanning registration (the amounts of color deviations in the sub-scanning direction), the interval values (y1, m1, and c1) between the pattern of the standard color (K) and the patterns of the objective colors (Y, M, and C) are calculated using the transverse patterns. The calculated interval values are compared with the previously-stored ideal interval values (y0, m0, and c0). The amounts of the positional deviations of the objective colors (Y, M, and C) from the standard color (K) can be calculated from (the interval value y1−the ideal interval value y0), (the interval value m1−the ideal interval value m0), and (the interval value c1−the ideal interval value c0).

Further, in the calculation of the deviation amount of the main-scanning registration (the amounts of the color deviations in the main-scanning direction), the interval values (y2, k2, m2, and c2) between the K, Y, M, and C transverse patterns and the K, Y, M, and C diagonal line patterns are first calculated, respectively. The difference values between the interval value of the standard color (K) and the interval values of the non-standard colors using the calculated interval values. The difference values correspond to the amounts of the positional deviations in the main-scanning direction. This is because the interval of a transverse pattern and the corresponding diagonal line pattern becomes wider or narrower than the intervals of the other transverse patterns and the corresponding diagonal line patterns when the deviation occurs in the main-scanning direction because the diagonal line patterns are inclined at a predetermined angle to the main-scanning direction. In other words, the amounts of the positional deviations between the black and the yellow, the black and the magenta, and the black and the cyan in the main-scanning direction can be calculated from (the interval value k2−the interval value y2), (the interval value k2−the interval value m2), and (the interval value k2−the interval value c2). As described above, the amounts of the registration deviations in the sub-scanning direction and in the main-scanning direction can be obtained.

Further, the skew and the errors of the main-scanning magnifications among the detecting sensors 5*a*, 5*b*, and 5*c* can also be found based on the results separately detected. The skew component can be obtained, for example, by the calculation of the difference of the deviation amounts of the sub-scanning registration separately detected at the detecting sensor 5*a* and the detecting sensor 5*c*. The deviation of the errors of the magnifications can further be obtained by the calculations of both of the difference of the deviation amounts of the main-scanning registration separately detected at the detecting sensor 5*a* and the detecting sensor 5*b* and the difference of the deviation amounts of the main-scanning registration separately detected at the detecting sensor 5*b* and the detecting sensor 5*c*. The correction process for correcting an image forming condition under which a color image is formed on the intermediate transfer belt 130 is performed based on each of the amounts of the positional deviations obtained as described above.

As the correction process, for example, the timings when the light beams Y, K, M, and C are emitted to the photosensitive elements 120*y*, 120*k*, 120*m*, and 120*c* are adjusted such that the amounts of the positional deviations are roughly in accordance with each other. The correction process is also performed by the adjustment of the inclinations of the reflecting mirrors (not shown in the drawings) that reflect the light beams. Driving a stepping motor (not shown in the drawings) causes the adjustment of the inclinations of the reflecting mirrors. Note that changing the image data can also correct the amounts of the positional deviations. This can obtain the amounts of the registration deviations in the sub-scanning direction and in the main-scanning direction.

Next, a case in which positional deviation correcting pattern image is formed on the intermediate transfer belt 130 and detected with the detecting sensors will be described.

Figure 6:
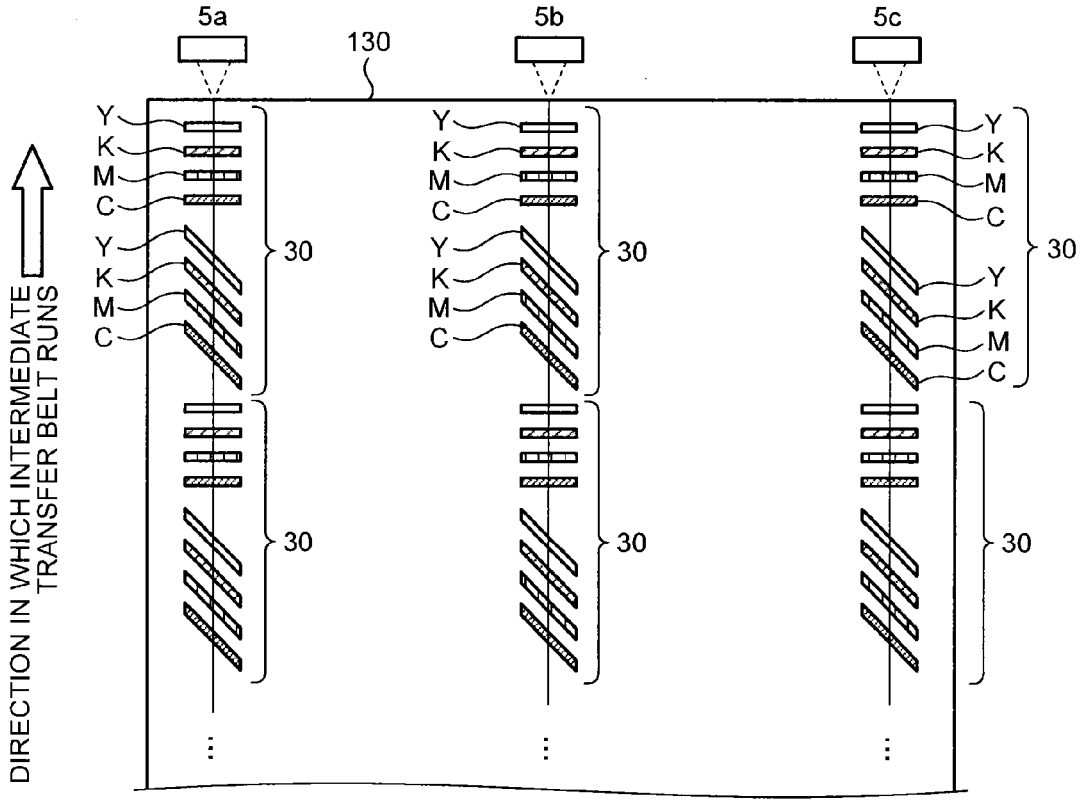
FIG. 6 is a view when three detecting sensors detect eight sets and three rows of marks formed as positional deviation correcting pattern images on an intermediate transfer belt.

FIG. 6 is a view when the three detecting sensors 5*a*, 5*b*, and 5*c* detect eight sets and three rows of marks 30 formed in as a positional deviation correcting pattern image on an the intermediate transfer belt 130. When the marks 30 are also formed at the position to be detected by the detecting sensor 5*b* as described above, the region at which the marks 30 are to be formed overlaps with the region at which an image to be transferred on the sheet P is formed so that the detections of the marks 30 and the successive corrections cannot be performed in parallel with the formation of the image. Thus, such detections and corrections are performed, for example, after the completion of a print job or just after the image forming apparatus 100 is powered on, in other words, at the time when a print is not performed. When the three rows of the marks 30 are formed on the intermediate transfer belt 130 and are detected, the positional deviations can be calculated at many points on the intermediate transfer belt 130. This is preferable for improving the accuracy of the corrections.

Figure 7:
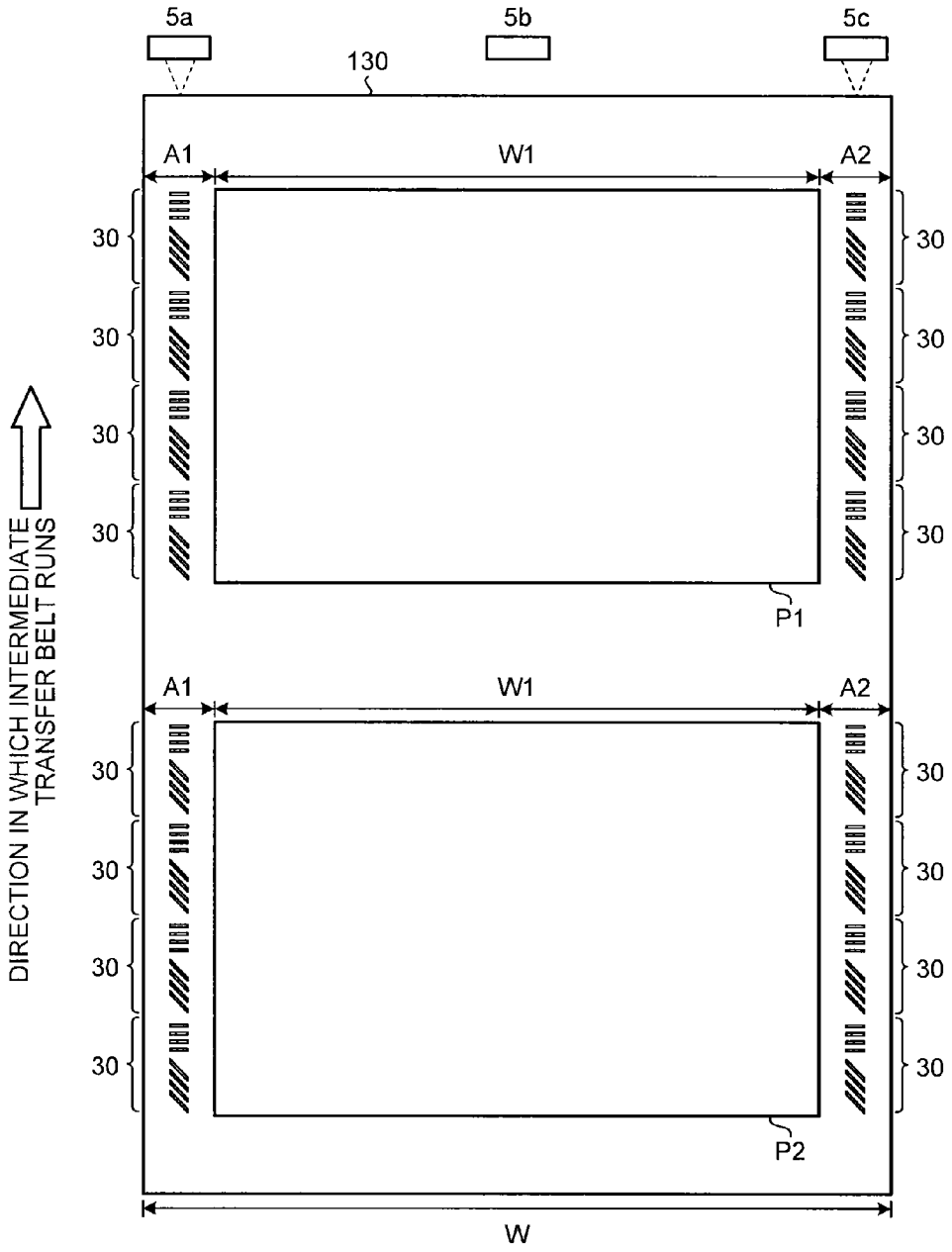
FIG. 7 is a view of an example of the intermediate transfer belt and detecting sensors when positional deviation correcting pattern images are formed in parallel with the formation of images to be transferred on the sheets.

FIG. 7 is a view of an example of the intermediate transfer belt 130 and the detecting sensors 5*a*, 5*b*, and 5*c* when positional deviation correcting pattern images are formed in parallel with the formation of images to be transferred on the sheet P. Herein, the images to be transferred on the sheet P are formed at image forming regions P1 and P2 on the intermediate transfer belt 130. The image forming regions P1 and P2 is set depending on the sheet P on which the images are to be transferred and both of the regions P1 and P2 have a size of A4 landscape in that case. The intermediate transfer belt 130 has, as a width in the main-scanning direction, a width W wider than a width W1 of the image forming regions P1 and P2 having the landscape A4 size in the main-scanning direction in that case. As a result of that, there are edge regions A1 and A2 at which the images to be transferred on the sheet P are not formed at the main-scanning direction edges at the outsides of the image forming regions P1 and P2 on the intermediate transfer belt 130. Note that the edge regions A1 and A2 have the same width in the main-scanning direction when the image forming regions P1 and P2 are centered in the main-scanning direction of the intermediate transfer belt 130. However, the edge regions A1 and A2 may have different widths.

The positions of the edge regions A1 and A2 in the main-scanning direction correspond to the placements of the detecting sensors 5*a* and 5*c*. Then, eight sets and only two rows of the mark 30 are formed at the edge regions A1 and A2 over the image forming regions P1 and P2 (in other words, over two pages) as the positional deviation correcting pattern images in parallel with the formation of the images at the image forming regions P1 and P2. In that case, the detections of the positional deviations, the calculations of the amounts of the corrections, and the corrections are performed using the positional deviation correcting pattern images formed at the edge regions A1 and A2 over the image forming regions P1 and P2.

Note that, although four sets of the mark 30 are formed at an edge of one of the image forming regions, the number of the sets to be formed can be varied depending on the size of the image forming region. Forming the marks 30 over two pages as described above can increase the number of marks 30 to be formed. This averages the information about the positional deviations or the like from the detecting sensors so that the accuracy of the corrections can be improved. On the other hand, a positional deviation correcting pattern image is not formed at the position overlapping with the image forming regions P1 and P2 and corresponding to the detecting sensor 5*b*.

The formation of the positional deviation correcting pattern images is started at a predetermined executive timing while the image forming regions are continuously formed on the intermediate transfer belt 130. The executive timing is, for example, at the time when 10 pages or more have continuously been printed, or at the time when the temperature at a predetermined part in the image forming apparatus 100 has increased by one degree or more from the standard value.

Figure 8:
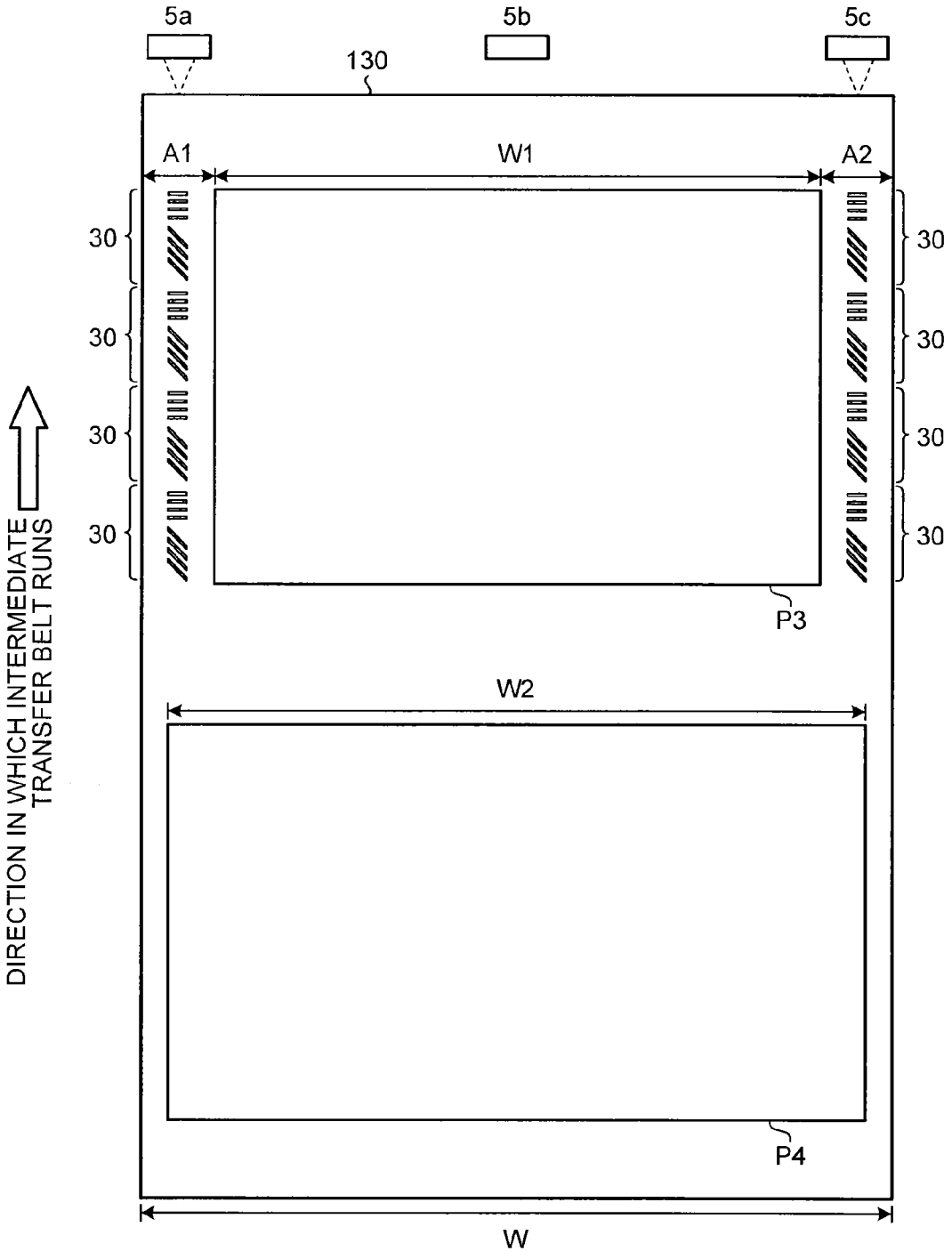
FIG. 8 is a view of another example of the intermediate transfer belt and the detecting sensors when positional deviation correcting pattern images are formed in parallel with the formation of images to be transferred on the sheets.

FIG. 8 is a view of another example of the intermediate transfer belt 130 and the detecting sensors 5*a*, 5*b*, and 5*c* when a positional deviation correcting pattern image is formed in parallel with the formation of images to be transferred on the sheet P. In that case, images to be transferred on the sheet P are formed at image forming regions P3 and P4 on the intermediate transfer belt 130. In that case, while the image forming region P3 has the landscape A4 size and has the width W1 in the main-scanning direction, the image forming region P4 has a size of SRA3 and has a width W2 wider than the width W1. As a result of that, there are edge regions A1 and A2 at which a positional deviation correcting pattern image can be formed at the main-scanning direction edges at the outside of the image forming region P3 on the intermediate transfer belt 130. However, there is not a region at which a positional deviation correcting pattern image can be formed at the main-scanning direction edges at the outside of the image forming region P4.

In light of the foregoing, in that case, the detections of the positional deviations, the calculations of the amounts of the corrections, and the corrections are performed using only the positional deviation correcting pattern image that has first been formed from the start of the formation of the positional deviation correcting pattern images, in other words, using only the positional deviation correcting pattern image that has been formed at the edge regions A1 and A2 of the image forming region P3. This restrains the reduction in the throughput because it is not necessary to extend the space between the sheets in order to form positional deviation correcting pattern images even when the transfer sheets have different sizes, for example, because of print jobs for transfer sheets having different sizes.

Figure 9:
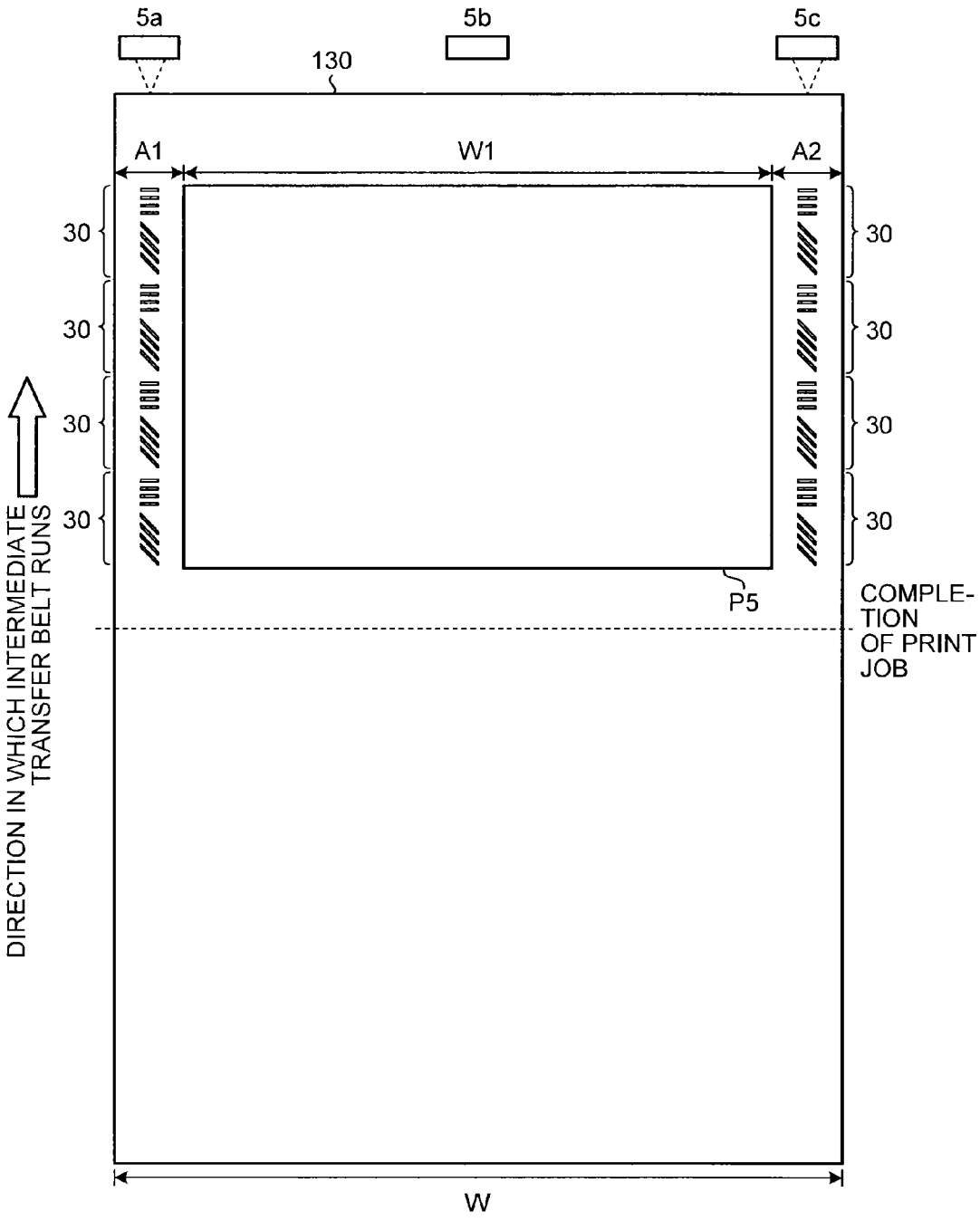
FIG. 9 is a view of another example of the intermediate transfer belt and the detecting sensors when positional deviation correcting pattern images are formed in parallel with the formation of images to be transferred on the sheets.

FIG. 9 is a view of another example of the intermediate transfer belt 130 and the detecting sensors 5*a*, 5*b*, and 5*c* when a positional deviation correcting pattern image is formed in parallel with the formation of an image to be transferred on the sheet. In that case, the image to be transferred on the sheet P is formed at an image forming region P5 on the intermediate transfer belt 130. The image forming region P5 has the landscape A4 size and has the width W1 in the main-scanning direction. Thus, there are image region outside edge regions A1 and A2 at which a positional deviation correcting pattern image can be formed at the main-scanning direction edges outside the image forming region. However, the print job is completed with the transfer (print) of the image formed at the image forming region P5 on the sheet P in the case of FIG. 9. Thus, a positional deviation correcting pattern image cannot be formed on the intermediate transfer belt 130 after the completion.

In light of the foregoing, in that case, the detections of the positional deviations, the calculations of the amounts of the corrections, and the corrections are performed according to the timing of the completion of the print job and using only the positional deviation correcting pattern image that has first been formed from the start of the formation of the positional deviation correcting pattern images, in other words, using only the positional deviation correcting pattern image that has been formed at the edge regions A1 and A2 of the image forming region P5. Thus, the detections of the positional deviations, the calculations of the amounts of the corrections, and the corrections can be performed even when the print job is halfway stopped.

Figure 10:
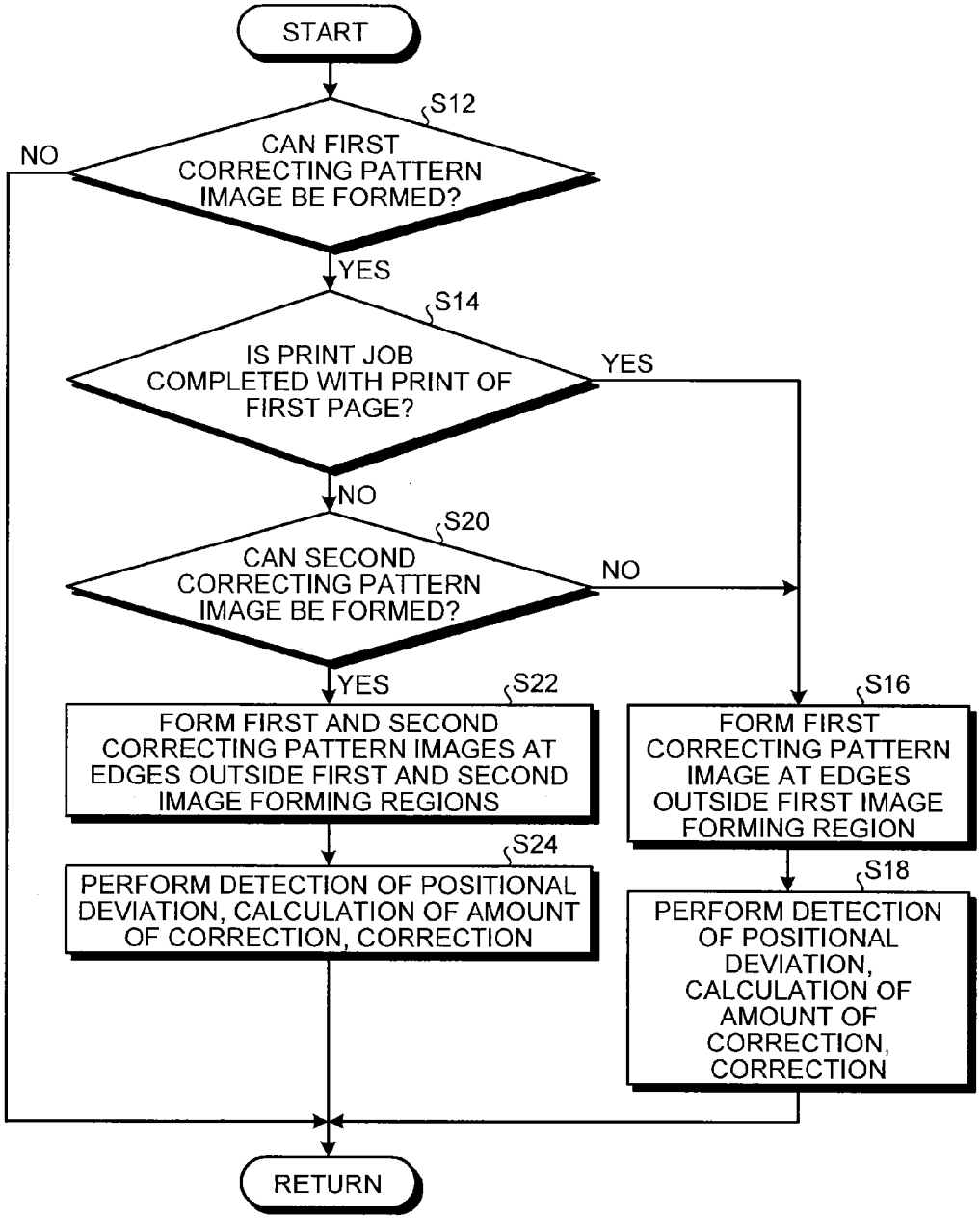
FIG. 10 is a flowchart of the correction process according to an embodiment of the present invention.

FIG. 10 is a flowchart of the correction process according to the present. The CPU 1 determines as step S12 whether the image forming region at which an image are first formed on the intermediate transfer belt 130 after the correction process has been completed has a size in which the first positional deviation correcting pattern image can be formed at the edges outside the image forming region. When determining that the image forming region has the size in which the first positional deviation correcting pattern image can be formed at the edges outside the image forming region (Yes in step S12), the CPU 1 performs the following step S14. When determining that the image forming region does not have the size in which the first positional deviation correcting pattern image can be formed at the edges outside the image forming region (No in step S12), the CPU 1 returns the process.

The CPU 1 determines as step S14 whether the print job is completed with the print of the first formed image (or, namely, the print of the first page). When determining that the print job is completed (Yes in step S14), the CPU 1 forms the first correcting pattern image at only the edges outside the image forming region at which the image is first formed as step S16. The CPU subsequently performs the detections of the positional deviations, the calculations of the amounts of the corrections, and the corrections as step S18, and returns the process. On the other hand, when determining that the print job is completed (No in step S14), the CPU 1 performs step S20 to be described below.

The CPU 1 determines as step S20 whether the image forming region at which an image is secondarily formed on the intermediate transfer belt 130 has a size in which the second correcting pattern image can be formed at the edges outside the image forming region. When determining that the image forming region has the size in which the second correcting pattern image can be formed at the edges outside the image forming region (Yes in step S20), the CPU 1 performs the following steps S22 and step S24. When determining that the image forming region does not have the size in which the second correcting pattern image can be formed at the edges outside the image forming region (No in step S20), the CPU 1 performs the above-mentioned steps S16 and S18, in other words, the CPU 1 forms the first correcting pattern at only the edges outside the image forming region at which the image is first formed, and subsequently performs the detections of the positional deviations, the calculations of the amounts of the corrections, and the corrections as step S18. Then, the CPU 1 returns the process.

The CPU 1 forms the first correcting pattern at only the edges outside the image forming region at which the image is first formed and forms the second correcting pattern at only the edges outside the image forming region at which the image is secondarily formed as step S22. The CPU 1 subsequently performs the detections of the positional deviations, the calculations of the amounts of the corrections, and the corrections as step S24. Then, the CPU 1 returns the process.

According to the flowchart, a first correction mode described in steps S16 and S18 and a second correction mode described in steps S22 and S24 can be switched and performed depending on the width of the image forming region (or, namely, the width of the transfer material in the main-scanning direction) or the timing of the completion of the print job.

According to the embodiments of the present invention, at least a positional deviation correcting pattern is formed at the edges outside the image forming region such that the detections of the positional deviations, the calculations of the amounts of the corrections, and the corrections are performed based on the positional deviation correcting pattern images. This restrains the reduction in the throughput because it is not necessary to extend the space between the sheets in order to form the positional deviation correcting pattern images even when the transfer sheets have different sizes, for example, because of print jobs for transfer sheets having different sizes.

Note that, although both of the image forming regions P1 and P2 have the landscape A4 size in FIG. 7, the second correction mode is performed when the two image forming regions have a size in which the positional deviation correcting pattern image can be formed at the edges outside each of the image forming regions even when the image forming regions do not have the same size as described above.

FIGS. 7 to 10 illustrate the case in which the two image forming regions are formed on the intermediate transfer belt 130. However, more image forming regions can be formed. In such a case, test pattern images are formed the edges outside the image forming regions of the first number of (one or more) of images, for example, in the first correction mode. The test pattern images can be formed the edges outside the image forming regions of second number larger than the first number of images in the second correction mode.

Further, a density correction can also be performed using a density correcting test pattern image instead of the positional deviation correcting test pattern image. Both of the positional deviation correction and the density correction can also be performed using both of the positional deviation correcting test pattern image and the density correcting test pattern image.

Figure 11:
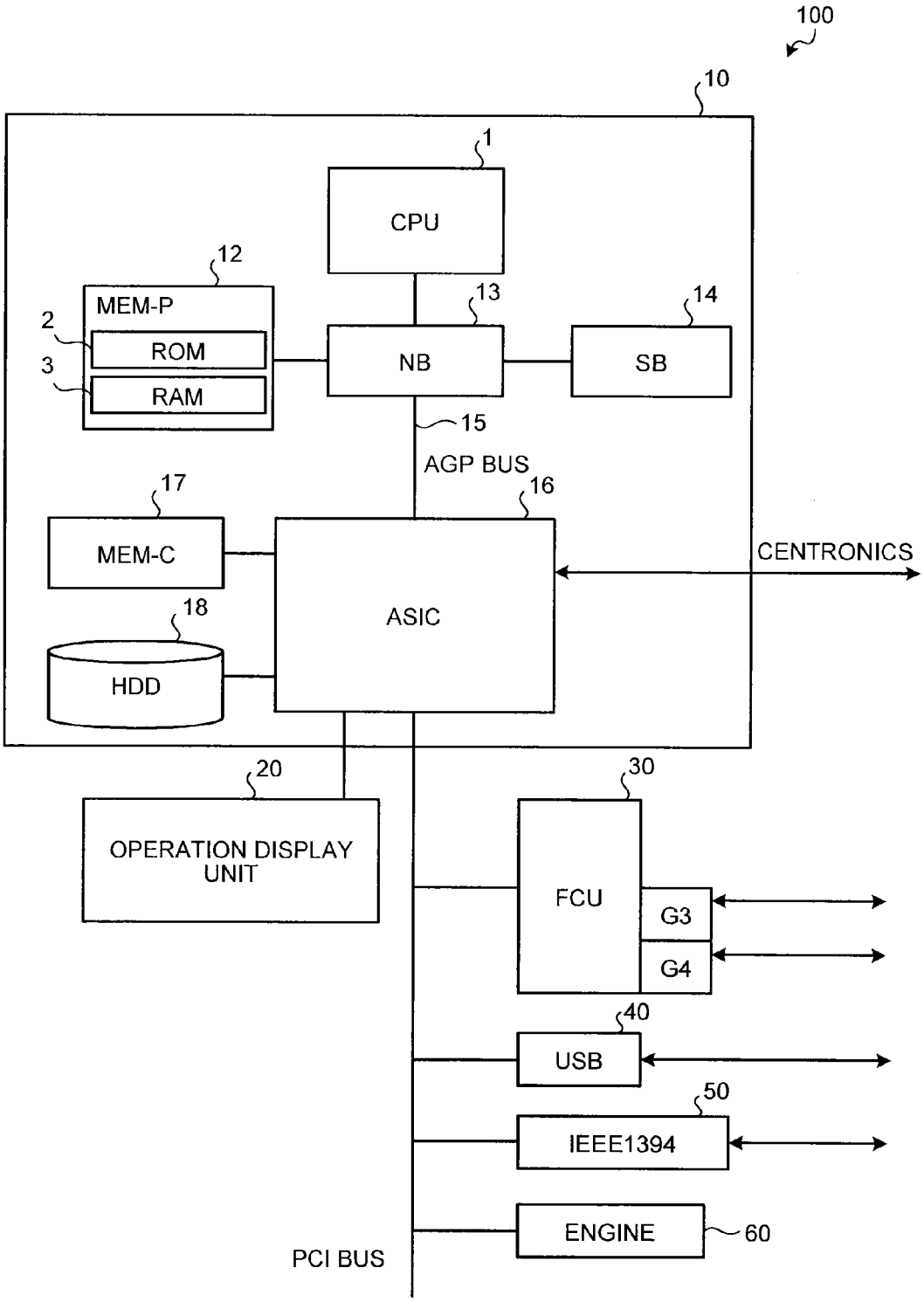
FIG. 11 is a block diagram of the hardware configuration of the image forming apparatus according to an embodiment of the present invention.

FIG. 11 is a block diagram of the hardware configuration of the image forming apparatus according to the present embodiment. As illustrated in the present drawing, the image forming apparatus 100 has a configuration in which a controller 10, and an engine unit (engine) 60 are connected to each other through a peripheral component interface (PCI) bus. The controller 10 is configured to control whole the image forming apparatus 100 and control the drawing, the communication, and the input from an operating unit (not illustrated in the drawings). The engine unit 60 is, for example, a printer engine capable of connecting to the PCI bus, for example, a black and white plotter, a one-drum color plotter, a four-drum color plotter, a scanner, or a facsimile unit. Note that the engine unit 60 includes a data processing unit for error diffusion, gamma conversion or the like in addition to the so-called engine unit, for example, a plotter.

The controller 10 includes the CPU 1, a north bridge (NB) 13, a system memory (MEM-P) 12, a south bridge (SB) 14, a local memory (MEM-C) 17, an application specific integrated circuit (ASIC) 16, and a hard disk drive (HDD) 18. An accelerated graphics port (AGP) bus 15 connects the north bridge (NB) 13 to the ASIC 16. The MEM-P 12 further includes a read only memory (ROM) 2 and a random access memory (RAM) 3.

The CPU 1 controls whole the image forming apparatus 100 and includes a chipset including the NB 13, the MEM-P 12, and the SB 14 in such a way as to be connected to the other devices through the chipset.

The NB 13 is a bridge that connects the CPU 1 to the MEM-P 12, the SB 14, and the AGP 15 and includes a memory controller that controls the reading and writing to the MEM-P 12, a PCI mater, and an AGP target.

The MEM-P 12 is a system memory used as a memory for storing a program or data, a memory for developing the program or the data, or a memory for the drawing for a printer, and includes the ROM 2 and the RAM 3. The ROM 2 is a read only memory used as the memory for storing a program or data. The RAM 3 is a writable and readable memory used as the memory for developing the program or the data, or the system memory for the drawing for a printer.

The SB 14 is a bridge that connects the NB 13 to the PCI device, and the peripheral devices. The SB 14 is connected to the NB 13 through the PCI bus to which, for example, a network interface (I/F) unit is also connected.

The ASIC 16 is an integrated circuit (IC) that is for image processing and includes a hardware constitute element for image processing. The ASIC 16 works as a bridge connecting the AGP 15, the PCI bus, the HDD 18 and the MEM-C 17 to each other. The ASIC 16 includes the PCI target, the AGP master, an arbiter (ARB) that is the core of the ASIC 16, a memory controller that controls the MEM-C 17, a plurality of direct memory access controllers (DMAC) that, for example, rotate image data with a hardware logic or the like, and the PCI unit that forwards the data to the engine unit 60 through the PCI bus. A facsimile control unit (FCU) 30, a universal serial bus (USB) 40, and the institute of electrical and electronics engineers 1394 (IEEE 1394) interface 50 are connected to the ASIC 16 though the PCI bus. An operation display unit 20 is directly connected to the ASIC 16.

The MEM-C 17 is a local memory used as a buffer for an image for copying, or a code buffer. The hard disk drive (HDD) 18 is storage for storing image data, a program, font data, and a form.

The AGP 15 is a bus interface for a graphics accelerator card that has been proposed in order to speed up graphic processes. The AGP 15 causes the graphics accelerator card to directly access the MEM-P 12 with high throughput in order to cause the graphics accelerator card to operate at a high speed.

Note that the program to be executed in the image forming apparatus according to the present embodiments is provided after previously being installed in the ROM or the like. The program to be executed in the image forming apparatus according to the present embodiment can be an installable or executable file and be recorded on a computer-readable storage medium such as a CD-ROM, a flexible disk (FD), a CD-R, and a digital versatile disk (DVD).

Further, the program to be executed in the image forming apparatus according to the present embodiment can be configured to be stored on a computer connected to a network such as the Internet in such a way as to be downloaded through the network. Further, the program to be executed in the image forming apparatus according to the present embodiment can be provided or distributed through a network such as the Internet.

The program to be executed in the image forming apparatus according to the present embodiment has a modular composition including the above-mentioned units (control unit). As actual hardware, the CPU (processor) reads the program from the ROM to execute the program so that each of the units is loaded on a main storage apparatus and is generated on the main storage apparatus.

Note that, although the examples in which the image forming apparatus of the present invention is applied to an MFP including at least two functions of a copying machine, a printer, a scanner, and a facsimile are cited in the embodiments, the present invention can also be applied to an image forming apparatus for any of a copying machine, a printer, a scanner apparatus, a facsimile apparatus, and the like.

The present invention produces an effect of adjusting an image without reducing the throughput.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

at least one first image carrier configured to carry an electrostatic latent image thereon;

an image writing unit configured to write the electrostatic latent image onto the at least one first image carrier, the electrostatic latent image including a test pattern image;

a second image carrier configured to move along a transfer position facing to the at least one first image carrier;

a first transfer unit provided opposite to the at least one first image carrier across the second image carrier and configured to obtain a subject image by transferring the electrostatic latent image carried on the at least one first image carrier onto the second image carrier in a superimposing manner;

a second transfer unit provided in contact with the second image carrier and configured to transfer the subject image transferred on the second image carrier to a transfer material and convey the transfer material;

a test pattern detection unit configured to detect the test pattern image;

a control unit configured to correct an image forming condition of the subject image based on a result from the detection of the test pattern image, wherein the test pattern image is provided on the second image carrier at an area being out of the image forming area and being limited in a conveying way of the second image carrier to a same range as the subject image along a main-scanning direction, and wherein the control unit instructs the image writing unit to write the test pattern image only when the control unit determines that a difference between a length of the transfer material in a direction perpendicular to the conveying way and a width of the second image carrier is sufficient to form the test pattern image;

the control unit being configured to correct the image forming condition according to a first correction mode in which the subject image is formed in a first image carrying area of the second image carrier including at least one image forming region, and the test pattern image is formed only at portions outside the at least one image forming region in the main-scanning direction of the subject image, and the control unit corrects the image forming condition of the image based on a result from the detection of the test pattern image; and a second correction mode in which the subject image is formed in a second image carrying area of the second image carrier including image forming regions more than a number of the at least one image forming region included in the first image carrying area, and the test pattern image is formed at portions outside the image forming regions more than the number of the at least one image forming region included in the first image carrying area and outside a region in the main-scanning direction of the subject image, and the control unit corrects the image forming condition of the image based on a result from the detection of the test pattern image, wherein the control unit performs the first correction mode in response to the subject image being completely formed in a sheet of the transfer material, wherein the control unit performs the first correction mode when the subject image is not completely formed in the sheet of the transfer material only if a difference between a length of a subsequent transfer material in a direction perpendicular to the conveying way and the width of the second image carrier is not sufficient to form the test pattern image, and wherein the control unit performs the second correction mode if the subject image is not completely formed in the sheet of the transfer material and the difference between the length of the subsequent transfer material in a direction perpendicular to the conveying way and the width of the second image carrier is sufficient to form the test pattern image.

2. The image forming apparatus set forth in claim 1, wherein the control unit performs the second correction mode if the subject image is not completely formed in the sheet of the transfer material and all transfer materials have the same size.

3. An image adjusting method performed in the image forming apparatus set forth in claim 1, the image adjusting method comprising:

by the control unit, determining whether or not a difference between the length of the transfer material in a direction perpendicular to the conveying way and the width of the second image carrier is sufficient to form the test pattern image;

instructing the writing unit to write the electrostatic latent images of the subject image and the test pattern image when a decision that the difference is sufficient to form the test pattern image is made by the control unit;

by the test pattern detecting unit, detecting the test pattern image; and correcting an image forming condition by averaging the result from the detection of the test pattern image to specify the misalignment of the subject image.

4. A computer readable storage medium storing a program causing a computer to perform the method set forth in claim 3.

5. An image correction unit for correcting an image formed by an image forming apparatus, the image forming apparatus comprising:

at least one first image carrier configured to carry an electrostatic latent image thereon;

an image writing unit configured to write the electrostatic latent image onto the at least one first image carrier, the electrostatic latent image including a test pattern image;

a second image carrier configured to move along a transfer position facing to the at least one first image carrier;

a first transfer unit provided opposite to the at least one first image carrier across the second image carrier and configured to obtain a subject image by transferring the electrostatic latent image carried on the at least one first carrier onto the second image carrier in a superimposing manner; and a second transfer unit provided in contact with the second image carrier and configured to transfer the subject image transferred on the second image carrier to a transfer material and convey the transfer material, wherein the test pattern image is provided on the second transfer unit at an area being out of the image forming area and being limited in a conveying way of the second image carrier to a same range as the subject image along a main-scanning direction, the image correcting unit comprising:

a test pattern detection unit configured to detect the test pattern image;

a memory connected to the test patt detection unit;

a control unit connected to the test pattern detection unit and the memory and configured to perform a correction procedure stored in the memory based on a result from the detection of the test pattern detection unit; and an image writing control unit connected to the control unit and configured to control the image writing unit based on the setting value corrected by the control unit, wherein the control unit instructs the image writing unit to write the test pattern image only when the control unit determines that a difference between a length of the transfer material in a direction perpendicular to the conveying way and a width of the second image carrier is sufficient to form the test pattern image, the control unit being configured to correct the image forming condition according to a first correction mode in which the subject image is formed in a first image carrying area of the second image carrier including at least one image forming region, and the test pattern image is formed only at portions outside the at least one image forming region in the main-scanning direction of the subject image, and the control unit corrects the image forming condition of the image based on a result from the detection of the test pattern image; and a second correction mode in which the subject image is formed in a second image carrying area of the second image carrier including image forming regions more than a number of the at least one image forming region included in the first image carrying area, and the test pattern image is formed at portions outside the image forming regions more than the number of the at least one image forming region included in the first image carrying area and outside a region in the main-scanning direction of the subject image, and the control unit corrects the image forming condition of the image based on a result from the detection of the test pattern image, wherein the control unit performs the first correction mode in response to the subject image being completely formed in a sheet of the transfer material, wherein the control unit performs the first correction mode when the subject image is not completely formed in the sheet of the transfer material only if a difference between a length of a subsequent transfer material in a direction perpendicular to the conveying way and the width of the second image carrier is not sufficient to form the test pattern image, and wherein the control unit performs the second correction mode if the subject image is not completely formed in the first sheet of the transfer material and the difference between the length of the subsequent transfer material in a direction perpendicular to the conveying way and the width of the second image carrier is sufficient to form the test pattern image.

6. An image forming system comprising an image forming apparatus and image data producing unit for transmitting image data to be formed to the image forming apparatus, the image forming apparatus comprising:

at least one first image carrier configured to carry an electrostatic latent image thereon;

an image writing unit configured to write the electrostatic latent image onto the at least one first image carrier, the electrostatic latent image including a test pattern image;

a second image carrier configured to move along a transfer position facing to the at least one first image carrier;

a first transfer unit provided opposite to the at least one first image carrier across the second image carrier and configured to obtain a subject image by transferring the electrostatic latent image carried on the at least one first carrier onto the second image carrier in a superimposing manner;

a second transfer unit provided in contact with the second image carrier and configured to transfer the subject image transferred on the second image carrier to a transfer material and convey the transfer material;

a test pattern detection unit configured to detect the test pattern image;

a control unit configured to correct an image forming condition of the subject image based on a result from the detection of the test pattern image, wherein the test pattern image is provided on the second transfer unit at an area being out of the image forming area and being limited in a conveying way of the second image carrier to a same range as the subject image along a main-scanning direction, the control unit being configured to correct the image forming condition according to a first correction mode in which the subject image is formed in a first image carrying area of the second image carrier including at least one image forming region, and the test pattern image is formed only at portions outside the at least one image forming region in the main-scanning direction of the subject image, and the control unit corrects the image forming condition of the image based on a result from the detection of the test pattern image; and a second correction mode in which the subject image is formed in a second image carrying area of the second image carrier including image forming regions more than a number of the at least one image forming region included in the first image carrying area, and the test pattern image is formed at portions outside the image forming regions more than the number of the at least one image forming region included in the first image carrying area and outside a region in the main-scanning direction of the subject image, and the control unit corrects the image forming condition of the image based on a result from the detection of the test pattern image, wherein the control unit performs the first correction mode in response to the subject image being completely formed in a sheet of the transfer material, wherein the control unit performs the first correction mode when the subject image is not completely formed in the sheet of the transfer material only if a difference between a length of a subsequent transfer material in a direction perpendicular to the conveying way and the width of the second image carrier is not sufficient to form the test pattern image, and wherein the control unit performs the second correction mode if the subject image is not completely formed in the first sheet of the transfer material and the difference between the length of the subsequent transfer material in a direction perpendicular to the conveying way and the width of the second image carrier is sufficient to form the test pattern image.

7. The image correcting method set forth in claim 3, wherein the subject image is not completely formed in a sheet of the transfer material and the difference between the length of the subsequent transfer material in the direction perpendicular to the conveying way and the width of the second image carrier is not sufficient to form the test pattern image.

8. The image forming apparatus set forth in claim 1, wherein the test pattern image includes a set of patterns for specular reflective lights, the set of patterns including transverse patterns and diagonal patterns, the transverse patterns including a first four patterns perpendicular to the main-scanning direction, the first four patterns including a first pattern corresponding to yellow, a first pattern corresponding to black, a first pattern corresponding to magenta, and a first pattern corresponding to cyan, the diagonal patterns including a second four patterns each having a predetermined oblique inclination relative to the main-scanning direction, the second four patterns including a first pattern corresponding to yellow, a first pattern corresponding to black, a first pattern corresponding to magenta, and a first pattern corresponding to cyan.

9. The image adjusting method set forth in claim 3, wherein the test pattern image includes a set of patterns for specular reflective lights, the set of patterns including transverse patterns and diagonal patterns, the transverse patterns including a first four patterns perpendicular to the main-scanning direction, the first four patterns including a first pattern corresponding to yellow, a first pattern corresponding to black, a first pattern corresponding to magenta, and a first pattern corresponding to cyan, the diagonal patterns including a second four patterns each having a predetermined oblique inclination relative to the main-scanning direction, the second four patterns including a first pattern corresponding to yellow, a first pattern corresponding to black, a first pattern corresponding to magenta, and a first pattern corresponding to cyan.

10. The computer readable storage medium set forth in claim 4, wherein the test pattern image includes a set of patterns for specular reflective lights, the set of patterns including transverse patterns and diagonal patterns, the transverse patterns including a first four patterns perpendicular to the main-scanning direction, the first four patterns including a first pattern corresponding to yellow, a first pattern corresponding to black, a first pattern corresponding to magenta, and a first pattern corresponding to cyan, the diagonal patterns including a second four patterns each having a predetermined oblique inclination relative to the main-scanning direction, the second four patterns including a first pattern corresponding to yellow, a first pattern corresponding to black, a first pattern corresponding to magenta, and a first pattern corresponding to cyan.

11. The image correction unit set forth in claim 5, wherein the test pattern image includes a set of patterns for specular reflective lights, the set of patterns including transverse patterns and diagonal patterns, the transverse patterns including a first four patterns perpendicular to the main-scanning direction, the first four patterns including a first pattern corresponding to yellow, a first pattern corresponding to black, a first pattern corresponding to magenta, and a first pattern corresponding to cyan, the diagonal patterns including a second four patterns each having a predetermined oblique inclination relative to the main-scanning direction, the second four patterns including a first pattern corresponding to yellow, a first pattern corresponding to black, a first pattern corresponding to magenta, and a first pattern corresponding to cyan.

12. The image forming system set forth in claim 6, wherein the test pattern image includes a set of patterns for specular reflective lights, the set of patterns including transverse patterns and diagonal patterns, the transverse patterns including a first four patterns perpendicular to the main-scanning direction, the first four patterns including a first pattern corresponding to yellow, a first pattern corresponding to black, a first pattern corresponding to magenta, and a first pattern corresponding to cyan, the diagonal patterns including a second four patterns each having a predetermined oblique inclination relative to the main-scanning direction, the second four patterns including a first pattern corresponding to yellow, a first pattern corresponding to black, a first pattern corresponding to magenta, and a first pattern corresponding to cyan.

* * * * *